US008387300B1

(12) United States Patent
Holland

(10) Patent No.: US 8,387,300 B1
(45) Date of Patent: Mar. 5, 2013

(54) RIFLE SCOPE ASSEMBLY AND METHOD OF INSTALLING THE SAME

(76) Inventor: Darrell Holland, Powers, OR (US)

( * ) Notice: Subject to any disclaimer, the term of this patent is extended or adjusted under 35 U.S.C. 154(b) by 457 days.

(21) Appl. No.: 12/218,140

(22) Filed: Jul. 11, 2008

(51) Int. Cl.
*F41G 1/387* (2006.01)

(52) U.S. Cl. ..... 42/127

(58) Field of Classification Search ..... 42/124–127
See application file for complete search history.

(56) References Cited

U.S. PATENT DOCUMENTS

| | | | | |
|---|---|---|---|---|
| 1,055,551 | A * | 3/1913 | Ommundsen | 42/136 |
| 2,018,960 | A | 11/1932 | Kuhn | |
| 2,629,176 | A * | 2/1953 | Ivy | 42/126 |
| 2,743,526 | A * | 5/1956 | Ivy | 42/126 |
| 2,857,675 | A * | 10/1958 | Kesselring | 42/127 |
| 2,911,723 | A * | 11/1959 | Ashbrook | 42/126 |
| 3,187,435 | A * | 6/1965 | Miller, Jr. | 42/126 |
| 3,276,127 | A * | 10/1966 | Abrahamson | 42/125 |
| 3,463,430 | A * | 8/1969 | Jimenez et al. | 42/124 |
| 3,579,840 | A * | 5/1971 | Heinzel | 42/127 |
| 4,114,302 | A | 9/1978 | Litman | |
| 4,216,600 | A * | 8/1980 | Brueckner et al. | 42/127 |
| 4,562,658 | A * | 1/1986 | Govett | 42/125 |
| 4,733,490 | A * | 3/1988 | Mulawski | 42/134 |
| 4,976,038 | A * | 12/1990 | Nattrass | 42/136 |
| 5,669,173 | A * | 9/1997 | Rodney, Jr. | 42/124 |
| 5,813,131 | A * | 9/1998 | Werre | 33/645 |
| 6,418,657 | B1 | 7/2002 | Brown | |
| 6,629,381 | B1 * | 10/2003 | Keng | 42/124 |
| 6,822,791 | B2 * | 11/2004 | Recknagel | 359/405 |
| 7,543,405 | B1 * | 6/2009 | Ivey | 42/125 |
| 2003/0051386 | A1 * | 3/2003 | Holler | 42/125 |
| 2003/0192224 | A1 * | 10/2003 | Kirk | 42/124 |
| 2004/0016169 | A1 * | 1/2004 | Poff, Jr. | 42/124 |
| 2007/0033852 | A1 * | 2/2007 | Adams | 42/124 |
| 2007/0266611 | A1 * | 11/2007 | Stover | 42/124 |
| 2008/0134561 | A1 * | 6/2008 | Clouser | 42/113 |

* cited by examiner

*Primary Examiner* — Michael Carone
*Assistant Examiner* — Reginald Tillman, Jr.
(74) *Attorney, Agent, or Firm* — Timothy E Siegel Patent Law, PLLC; Timothy E Siegel

(57) ABSTRACT

A method of attaching a rifle scope, having a windage knob, to a rifle having a rifle bore and that utilizes a scope mount having a top rail adapted to receive a scope at a predetermined orientation. The scope mount is attached to the rifle in a first manner, permitting adjustment of azimuth angle of the top rail relative to the rifle bore. Then a scope is attached to the scope mount and the error of the scope azimuth angle with respect to initial bullet direction is estimated. The azimuth angle of top rail relative to the rifle is adjusted by the azimuth angle error and the mounting of the scope to the rifle is finalized, thereby creating a rigid attachment.

8 Claims, 2 Drawing Sheets

RIFLE SCOPE ASSEMBLY AND METHOD OF INSTALLING THE SAME

A shooter aiming at a long-range target typically wishes to fire the bullet in a direction that compensates for the effects of both gravity and wind. To this end, the typical rifle scope is equipped with an elevation knob, which raises the upward angle of the gun barrel relative that of the scope, and a windage knob, which changes the azimuth angle of the scope relative to the scope mounting, as the shooter turns the knob.

Unfortunately, using conventional techniques, it is very difficult to mount a scope so as to eliminate misalignment with the gun barrel. The windage knob is frequently used to address this misalignment, by finding a windage knob setting that compensates for this misalignment, so that the azimuthal left/right alignment of the scope reticule with the gun barrel is improved. This, in turn, creates a number of problems. First, an extra complication is added to the task of aiming, because the shooter must note the azimuth angle necessary to compensate for the misalignment and add that angle to the angle necessary to compensate for actual wind deflection. Second, the range of adjustment possible by using the windage knob is moved from a range centered on zero, which is the most desirable, to one centered on the angle used to correct the azimuthal misalignment. Because of this a portion of the angular adjustment range is lost, in the angular direction that the windage knob must be turned to compensate for scope mount misalignment. Third, the error of windage knob adjustments is typically roughly related to the size of the adjustment. Because of the offset to compensate for misalignment, most windage knob adjustments will be larger than would otherwise be necessary. Fourth, due to the mechanics of scope adjustments, the further the windage adjustment is displaced from optical center, the more limited and/or inaccurate the elevation adjustment becomes. Accordingly, an additional inaccuracy is introduced into the shooting equation.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention may take the form of a method of attaching a rifle scope, having a windage knob, to a rifle having a rifle bore and that utilizes a scope mount having a top rail adapted to receive a scope at a predetermined orientation. The scope mount is attached to the rifle in a first manner, permitting adjustment of azimuth angle of the top rail relative to the rifle bore. Then a scope is attached to the scope mount and the error of the scope azimuth angle with respect to initial bullet direction is estimated. The azimuth angle of top rail relative to the rifle is adjusted by the azimuth angle error and the mounting of the scope to the rifle is finalized, thereby creating a rigid attachment.

In a second separate aspect, the present invention may take the form of a rifle assembly, including a rifle having a receiver. A rear base and a front base are both attached to the receiver and have an upwardly-facing threaded hole. A rail is attached to the rear base and the front base and has a first round aperture and a second aperture. A first fastener is conformal to and fit through the first round aperture and fastened into one of the upwardly-facing threaded holes and a second fastener, which is smaller than the second aperture in dimension transverse to the rifle, is fastened into one of the upwardly-facing threaded holes.

In a third separate aspect the present invention may take the form of a rifle assembly that includes a rifle, having a direction of bullet discharge. Additionally, a scope mount includes a base assembly, rigidly mounted to the rifle and defining a base assembly centerline and a rail, rigidly mounted to the base assembly. Also a scope is rigidly mounted on the rail and the scope is aligned to the direction of bullet discharge to within a minute-of-angle and misaligned to the base assembly centerline by more than a minute-of-angle.

In addition to the exemplary aspects and embodiments described above, further aspects and embodiments will become apparent by reference to the drawings and by study of the following detailed descriptions.

DETAILED DESCRIPTION OF THE PREFERRED. EMBODIMENT

Figure 1:
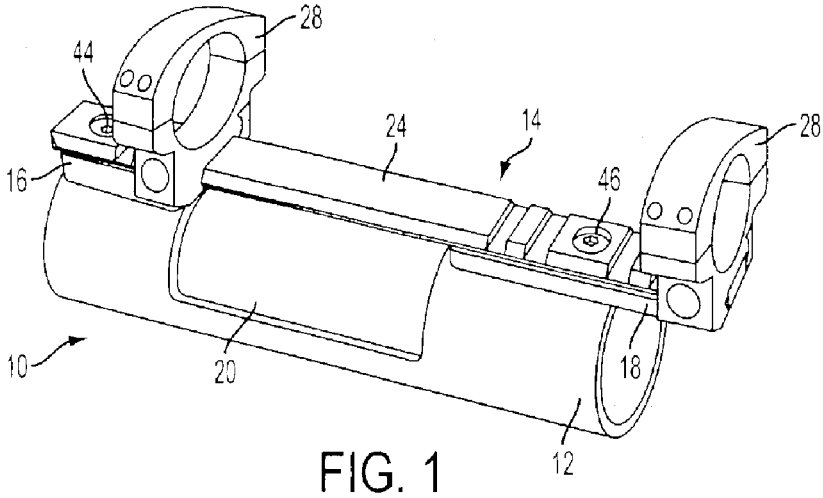
FIG. 1 is a perspective view of a scope mounted according to the present invention, mounted on a rifle receiver.

Referring to FIG. 1, a preferred embodiment of a rifle receiver/scope mount assembly 10 includes a rifle receiver 12 and an installed scope mount 14 including a rear base 16 and a front base 18, mounted rear and front, respectively, of an ejection port 20. A picatinny rail 24 is mounted to and bridges rear and front base 16 and 18. A scope 26 (FIG. 3) may be rigidly supported on rail 24, by way of c-rings 28, which fix the position of scope 26 relative to rail 24.

There is a military standard, designated MIL-STD-1913 having to do with picatinny rails, and the designation "1913 picatinny rail" is sometimes used to describe one. In one preferred embodiment the picatinny rail 24 meets the 1913 military standard, but in an alternative preferred embodiment, the picatinny rail 24 does not meet every specification set forth in the military standard.

In greater detail, rear base 16 and front base 18 both have a transversely concave bottom surface for fitting precisely against the contour of the receiver 22, which has been drilled and tapped to create a set of four threaded holes 30 for mounting of the rear base 16 and front base 18. Both bases 16 and 18 are mounted to the receiver with a pair of 82 degree counter bore screws 32 that fit and self-center in a pair of matching holes 34 in both rear and front base 16 and 18 and are rotated into the threaded holes 30 created in the receiver 22.

Figure 2:
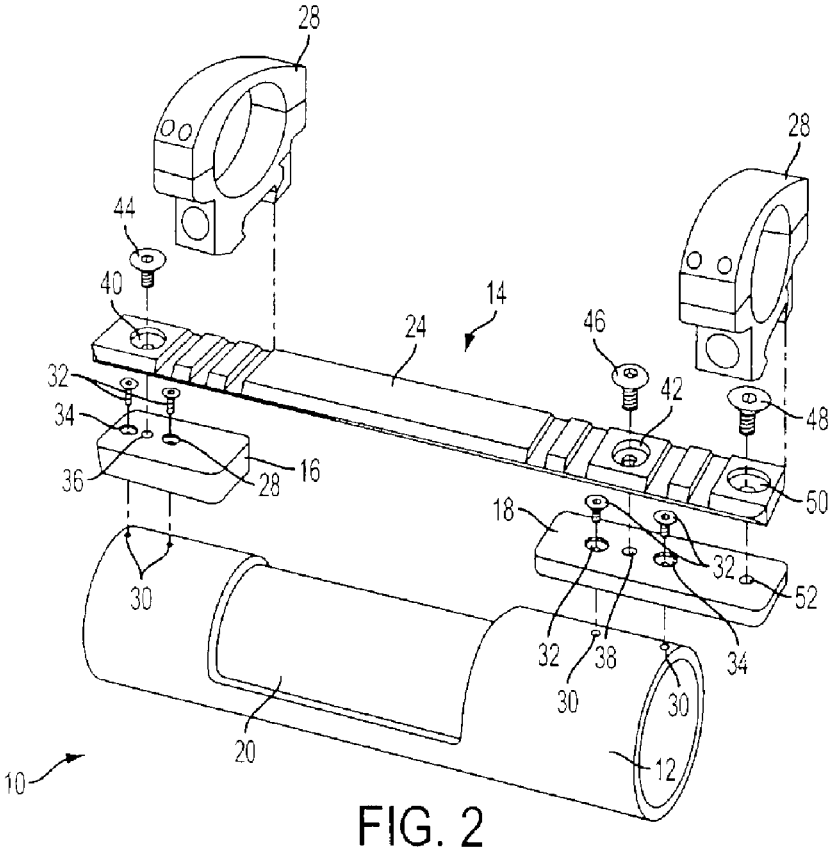
FIG. 2 is a perspective exploded view of the scope mount of FIG. 1.
Figure 2A:
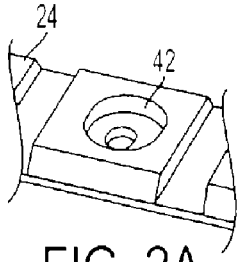
FIG. 2A is a perspective detail view of the rail front aperture, of the scope mount of FIG. 1.

Both bases 16 and 18 define an upwardly-opening threaded hole 36 and 38, respectively. The picatinny rail 24 defines a rear aperture 40 and a front aperture 42, which are aligned to threaded holes 36 and 38, respectively, and engaged thereto with threaded fasteners 44 and 46 respectively. Fastener 44 is an 82 degree counter bore screw, with rear aperture 34 having a matching shape, thereby facilitating the centering of fastener 44. Front aperture 42 is oval in shape (see FIG. 2A), with the major axis of the oval running transverse to the direction of the rail 24. When threaded fastener 46 is only loosely tightened, this permits play in the transverse dimension between the front of rail 24 and front base 18, which translates into play between the directionality of rail 24 and that of the gun barrel 60, thereby permitting adjustment in this directionality.

To install scope mount 14, a user first mounts bases 14 and 16 to the rifle 12. Rail 20 is mounted to rear base 16 by way of threaded fastener 44 and threaded fastener 46 is fastened through front aperture 36 into threaded hole 32 and is tightened only enough to meet an initial resistance. As described further below, at the end of the alignment process, a second front threaded fastener 48 is fit through a second front aperture 50 into a second threaded hole 52 in front base 18, to positively retain the rail position eliminating horizontal and vertical input.

Figure 3:
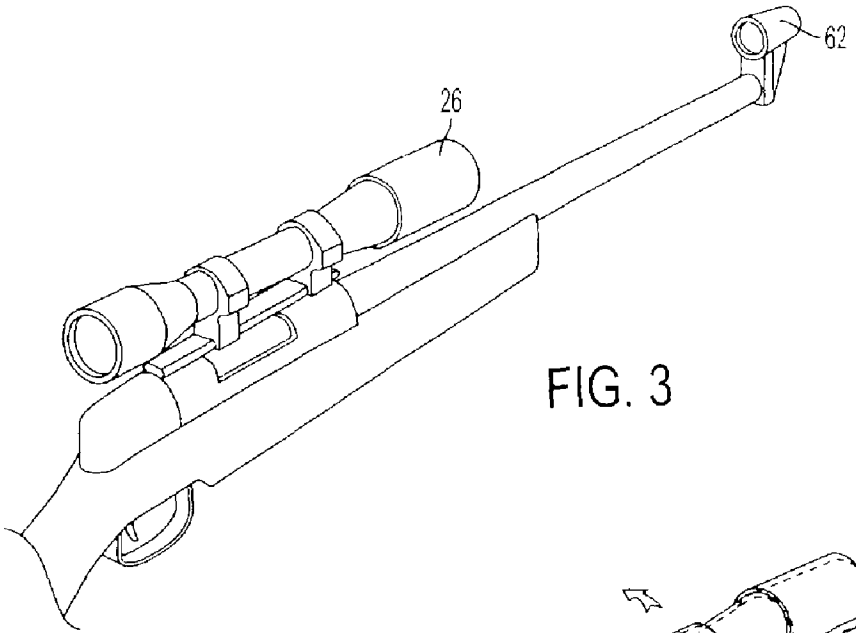
FIG. 3 illustrates a step of a method performed in accordance with the present invention, by showing a rifle, equipped with a scope and having a collimator attached to the end of the rifle barrel.
Figure 4:
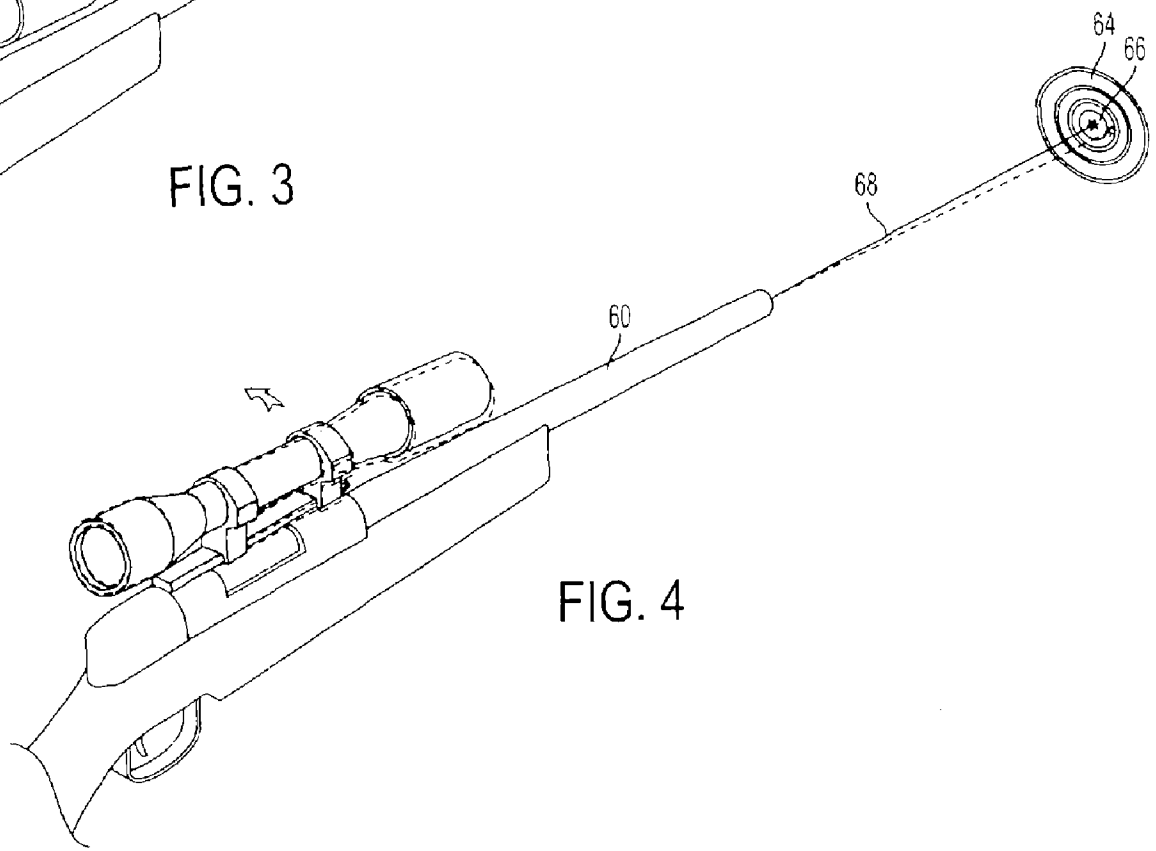
FIG. 4 illustrates a step of a method performed in accordance with the present invention, by showing a rifle, equipped with a scope, and a target that has been shot at, creating a bullet hole.

As shown in FIG. 3, a collimator 62 is attached to the end of rifle 12, thereby permitting a user to view the rifle bore 60 through the scope 26. This user then aligns the scope 26 reticule (not shown) to the bore center by gently pivoting the scope 26 about rear threaded fastener 40. When the reticule is aligned to the bore center, front threaded fastener 42 is tightened, preserving the alignment.

Although the scope is now aligned physically, there is still the possibility that variations from ideal on the interior surface of the gun barrel could cause the bullet to leave the barrel at a subtle angle to the direction of the barrel. To correct for this angle, the user takes the gun to either an enclosed firing range, or an outside firing range on a still day and fires at a target 64 that is relatively close (100 to 200 yards away), aiming at the bullseye 66. The user then notes the distance between the bullet hole and the bullseye 66, adjusts the windage knob and shoots again. When the user is satisfied that the windage knob is correctly adjusted to compensate for the angle between bore center 68 and bullet direction, he may reattach the collimator 62 and note the reticules location relative to the collimator grid. He then zeroes the windage knob and adjusts the angle between scope and bore 68 by adjusting the picatinny rail's orientation relative to bases 16 and 18, so that it equals the noted angle introduced by the windage knob, as set to compensate for bullet direction.

At this point an additional threaded hole 52 is formed in front base 18 by drilling and tapping. Fastener is fit through aperture 50 and threaded into this hole, being fastened tight and thereby positively retaining the spatial relationship of rail 24 to receiver 12 (and thereby to rifle barrel 68), thereby eliminating horizontal and vertical movement.

While a number of exemplary aspects and embodiments have been discussed above, those of skill in the art will recognize that there certain modifications, permutations, additions and sub-combinations of these aspects are possible. It is therefore intended that the following appended claims and claims hereafter introduced are interpreted to include all such modifications, permutations, additions and sub-combinations as are within their true spirit and scope.

The invention claimed is:

1. A method of mounting a rifle scope, having a windage knob, to a rifle having a rifle bore and a receiver defining an ejection port, said method comprising:

(a) providing a scope mount in disassembled form having a top rail adapted to receive a scope at a predetermined orientation and further having a rear base and a front base, each defining a top-opening threaded hole, said top rail having a front fastener aperture and a rear fastener aperture;

(b) rigidly mounting said rear base to said receiver rearward of said ejection port and rigidly mounting said front base to said receiver forward of said ejection port;

(c) mounting said top rail to said rear base by a rear threaded fastener fit through said rear fastener aperture into said rear base top-opening threaded hole and mounting said top rail to said front base by a front threaded fastener fit through said front fastener aperture into said front base top-opening threaded hole and wherein at least one of said fastener apertures is greater in transverse dimension than said threaded fastener fit through it, thereby permitting transverse play between said rail and at least one of said bases, after said threaded fasteners are fit through said fastener apertures and threaded into said bases' top-opening threaded holes and mounting a scope to said scope mount;

(d) measuring the error of the scope azimuth angle with respect to initial bullet direction, when the windage knob is set to zero;

(e) adjusting azimuth angle of top rail relative to said rifle by said azimuth angle error; and (f) finalizing said mounting of said scope mounting rail to said rifle, thereby creating a rigid, fixed attachment between said top rail and said rifle and, wherein when said windage knob is set to zero, scope azimuth direction is well aligned to direction of initial bullet travel and, accordingly, windage adjustment range of said windage knob is symmetric about direction of initial bullet travel.

2. The method of claim 1, wherein said top rail is a picatinny rail.

3. The method of claim 1, wherein said rear base and said front base are physically separate.

4. The method of claim 1, wherein said fastener aperture that is greater in transverse dimension is oval.

5. The method of claim 1, wherein said step of adjusting said azimuth angle of said top rail relative to said rifle by said azimuth angle error is performed by moving said top rail relative to one of said threaded fasteners, thereby exploiting the play permitted by said fastener aperture having greater transverse dimension.

6. The method of claim 1, wherein the step of measuring the error of the scope azimuth angle with respect to initial bullet direction includes placing a collimator on said rifle bore, viewing said collimator through said scope and noting the difference between the center of said bore and the reticule center.

7. The method of claim 1, wherein the step of measuring the error of the scope azimuth angle with respect to the rifle bore includes firing said rifle at a target center, thereby creating a bullet hole, and noting the horizontal difference between said target center and said bullet hole.

8. The method of claim 1, wherein the step of measuring the error of the scope azimuth angle with respect to initial bullet direction includes placing a collimator on said rifle bore, viewing said collimator through said scope and adjusting the scope azimuth angle to zero the difference between the center of said bore and the reticule center and then firing said rifle at a target center, thereby creating a bullet hole, and noting the horizontal difference between said target center and said bullet hole.

* * * * *